US010358887B2

(12) United States Patent
Wise et al.

(10) Patent No.: US 10,358,887 B2
(45) Date of Patent: Jul. 23, 2019

(54) DEGRADABLE ELEMENTS FOR DOWNHOLE APPLICATIONS

(71) Applicants: Tristan Wise, Spring, TX (US); James Doane, Friendswood, TX (US); Yusheng Yuan, Houston, TX (US)

(72) Inventors: Tristan Wise, Spring, TX (US); James Doane, Friendswood, TX (US); Yusheng Yuan, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 248 days.

(21) Appl. No.: 15/340,166

(22) Filed: Nov. 1, 2016

(65) Prior Publication Data

US 2018/0119508 A1 May 3, 2018

(51) Int. Cl.

| | |
|---|---|
| ***E21B 33/12*** | (2006.01) |
| ***E21B 29/00*** | (2006.01) |
| *E21B 43/12* | (2006.01) |

(52) U.S. Cl.
CPC ..... *E21B 33/12* (2013.01); *E21B 29/00* (2013.01); *E21B 43/126* (2013.01)

(58) Field of Classification Search
CPC ..... E21B 33/12; E21B 29/00; E21B 43/26
See application file for complete search history.

(56) References Cited

U.S. PATENT DOCUMENTS

| | | | | |
|---|---|---|---|---|
| 2011/0056702 | A1* | 3/2011 | Sharma | E21B 17/026 166/378 |
| 2013/0043041 | A1 | 2/2013 | McCoy et al. | |
| 2014/0020898 | A1 | 1/2014 | Holderman et al. | |
| 2014/0202708 | A1 | 7/2014 | Jacob et al. | |
| 2016/0258240 | A1 | 9/2016 | Fripp et al. | |

FOREIGN PATENT DOCUMENTS

WO 2010126715 A1 11/2010

OTHER PUBLICATIONS

International Search Report and Written Opinion for PCT Application No. PCT/US2017/054693, Application Filing Date Oct. 2, 2017; dated Jan. 16, 2018. 13 pages.

* cited by examiner

*Primary Examiner* — Robert E Fuller
(74) *Attorney, Agent, or Firm* — Cantor Colburn LLP

(57) ABSTRACT

A downhole element for use in a wellbore with a wellbore fluid. The downhole element includes a body formed from a dissolvable material to degrade at a first rate when exposed to the wellbore fluid, with at least one cavity defined by the body. A degradation agent is disposed within the at least one cavity. The at least one cavity selectively releases the degradation agent and the degradation agent degrades the body at a second rate when exposed to the wellbore fluid and the dissolvable material.

18 Claims, 3 Drawing Sheets

DEGRADABLE ELEMENTS FOR DOWNHOLE APPLICATIONS

BACKGROUND

This disclosure relates generally to degradable materials and systems that utilize same for downhole applications.

BACKGROUND OF THE ART

Wellbores are drilled in subsurface formations for the production of hydrocarbons (oil and gas). Hydrocarbons are trapped in various traps or zones in the subsurface formations at different depths. In order to facilitate the production of oil and gas, it is often desired to utilize fracturing operations. During fracturing operations, downhole elements are utilized to isolate zones to prevent and limit fluid flow. Such elements must be removed or otherwise destroyed before production operations can begin. Such removal operations may be costly and/or time consuming. It is desired to provide downhole elements that can provide desired functionality while quickly degrading after the desired time of operations and applications.

The disclosure herein provides controlled degradable materials and systems using the same to quickly degrade after use.

SUMMARY

In one aspect, a downhole element for use in a wellbore with a wellbore fluid is disclosed, including a body formed from a dissolvable material to degrade at a first rate when exposed to the wellbore fluid, at least one cavity defined by the body, a degradation agent disposed within the at least one cavity, wherein the at least one cavity selectively releases the degradation agent and the degradation agent degrades the body at a second rate when exposed to the wellbore fluid and the dissolvable material.

In another aspect, a method to accelerate degradation in a wellbore with a wellbore fluid is disclosed, including defining at least one cavity within a body of a downhole element wherein the body is formed from a dissolvable material, disposing a degradation agent within the at least one cavity, exposing the downhole element to the wellbore fluid, degrading a body at a first rate in response to the wellbore fluid, selectively releasing the degradation agent from the cavity, exposing the degradation agent to the wellbore fluid and the dissolvable material, and degrading the dissolvable material at a second rate in response to the wellbore fluid.

In yet another aspect, a system for use in a wellbore with a wellbore fluid is disclosed, including a casing string disposed within the wellbore, and a downhole element disposed within the casing string, the downhole element including a body formed from a dissolvable material to degrade at a first rate when exposed to the wellbore fluid, at least one cavity defined by the body, a degradation agent disposed within the at least one cavity, wherein the at least one cavity selectively releases the degradation agent and the degradation agent degrades the body at a second rate when exposed to the wellbore fluid and the dissolvable material.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures, wherein like numerals have generally been assigned to like elements and in which.

DESCRIPTION OF THE EMBODIMENTS

Figure 1:
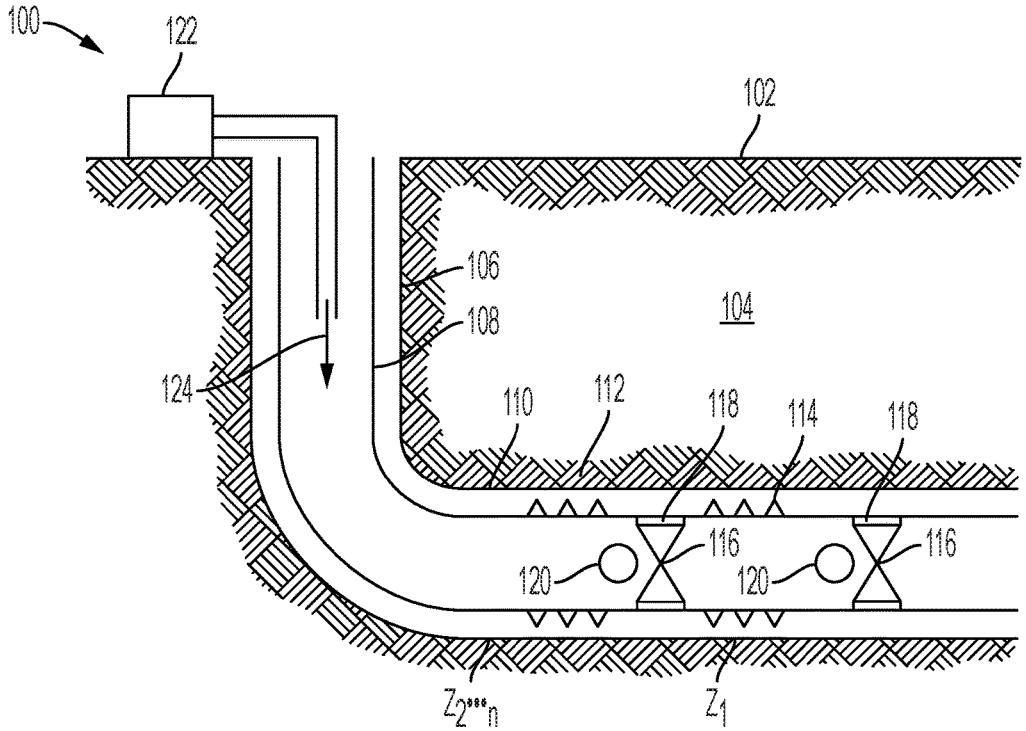
FIG. 1 is a schematic diagram of an exemplary completion system that includes downhole elements according to embodiments of the disclosure.

FIG. 1 shows an exemplary embodiment of a downhole system for fracturing (or fracing) operations to facilitate the production of oil and gas. System 100 includes a wellbore 106 formed in formation 104 with casing 108 disposed therein.

In an exemplary embodiment, a wellbore 106 is drilled from a surface 102 to a downhole location 110. Casing 108 may be disposed within wellbore 106 to facilitate production. In an exemplary embodiment, casing 108 is disposed through multiple zones of production Z1 . . . Zn in a downhole location 110. Wellbore 106 may be a vertical wellbore, a horizontal wellbore, a deviated wellbore or any other suitable type of wellbore or any combination thereof.

To facilitate fracturing operations, in an exemplary embodiment, frac plugs 116 are utilized within casing string 108. In certain embodiments, frac plugs 116 are utilized in conjunction with casing seals 118 and frac balls 120 to isolate zones Z1 . . . Zn for fracturing operations. In an exemplary embodiment, frac plugs 116 utilize casing seals 118 to seal plugs 116 against casing 108 of local zone 112 to prevent fluid flow therethrough. In certain embodiments, frac balls 120 are disposed at a downhole location 110 to obstruct and seal fluid flow in local zone 112 to facilitate flow to perforations 114.

In an exemplary embodiment, frac fluid 124 is pumped from a frac fluid source 122 to a downhole location 110 to flow through perforations 114 in a zone 112 isolated by frac plug 116 and frac ball 120. Advantageously, fracturing operations allow for more oil and gas available for production.

After fracturing operations, and before production operations, frac plugs 116 and other suitable elements are often removed or otherwise destroyed to allow the flow of oil and gas through casing 108. In various applications, downhole conditions may vary, causing degradation to occur at different rates. Advantageously, in an exemplary embodiment, the frac plug 116, and other suitable elements that may be used in conjunction with the frac plug 116, including, but not limited to a cone, body lock support ring, etc., herein are formed of a degradable construction with an additional degradation agent that can be selectively released to accelerate degradation of the selected downhole elements to reduce degradation time.

Figure 2:
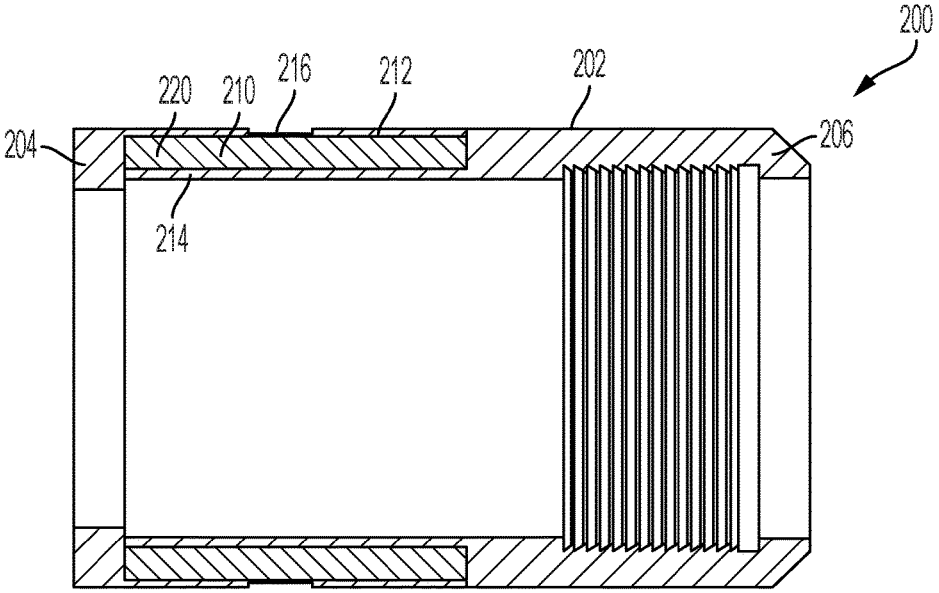
FIG. 2 is a schematic diagram of an exemplary frac plug sleeve for use in a downhole system, such as the one shown in FIG. 1, according to one embodiment of the disclosure.

FIG. 2 shows a frac plug sleeve 200 for use with downhole systems such as the system 100 shown in FIG. 1 for fracturing operations. In the illustrated embodiment, the frac plug sleeve 200 includes a housing 202 with at least one cavity 210 containing a degradation agent 220. In the illustrated embodiment, the frac plug sleeve 200 can be utilized to obstruct and seal fluid flow and be dissolved after use. In the illustrated embodiment, the elements of the frac plug sleeve 200 can be utilized with any suitable downhole element.

In the illustrated embodiment, the housing 202 of the frac plug sleeve 200 has a first end 204 and a second end 206. In certain embodiments, the first end 204 can be oriented either up hole or downhole. In the illustrated embodiment, the housing 202 can receive a frac ball to isolate frac fluid flow.

In the illustrated embodiment, the housing 202 of the frac plug sleeve 200 is formed from a dissolvable material. In the illustrated embodiment, the dissolvable material can be a corrodible material, a degradable polymeric material, and/or a degradable composite material. In certain embodiments, the corrodible material is a corrodible material, such as a controlled electrolytic metallic. In certain embodiments, the degradable polymeric material is polyglycolide. In the illustrated embodiment, the dissolvable material degrades at a first rate when exposed to the wellbore fluid. In certain applications, it may be desired to degrade the housing 202 at a faster rate than the inherent degradation rate of the housing 202 to allow for subsequent operations to be performed with minimal waiting or any intermediate operations.

The housing 202 includes at least one cavity 210. In the illustrated embodiment, the cavities 210 are defined by at least one of the outer wall 212 and the inner wall 214. In the illustrated embodiment, the cavities 210 are formed within the housing 202. Advantageously, the cavities 210 do not alter the primary function of the frac plug sleeve 200. Cavities 210 can be added to any suitable downhole device. In certain embodiments, the geometry of the housing 202 can be altered to include at least one cavity 210.

In the illustrated embodiment, the cavities 210 contain a degradation agent 220. The degradation agent 220 can be inserted into the cavity 210 during manufacturing. In certain embodiments, the degradation agent 220 can be inserted into the cavity 210 after manufacturing. In the illustrated embodiment, the degradation agent 220 can be any suitable substance to accelerate the degradation of the housing 202. In certain embodiments, the degradation agent 220 is not activated until it is in contact with the wellbore fluid. In certain embodiments, the degradation agent 220 is a dry acid, including, but not limited to boric acid, sodium bisulfate, oxalic acid, sulfamic acid, and phthalic acid.

During operation, the housing 202 is exposed to wellbore fluid. In response to the wellbore fluid, the housing 202 formed of the degradable material begins to dissolve. In the illustrated embodiment, at least one of the outer wall 212 and the inner wall 214 can degrade. After sufficient degradation, the cavity 210 can be exposed to the wellbore fluid to release the stored degradation agent 220. In certain embodiments, outer wall 212 and/or inner wall 214 can include a reduced thickness portion 216 to control and accelerate exposure of the cavity 210 to the wellbore fluid. In the illustrated embodiment, thickness of the outer wall 212, the inner wall 214 and the reduced thickness portion 216 can be modified to alter the period of time until the cavity 210, and accordingly, the degradation agent 220 is exposed to the wellbore fluid. Upon exposure of the cavity 210 and the degradation agent 220 within to the wellbore fluid and the housing 202, the housing 202 can be degraded at a second accelerated rate. Advantageously, the degradation rate of the frac plug sleeve 200 can be accelerated as desired without additional intervention.

Figure 3:
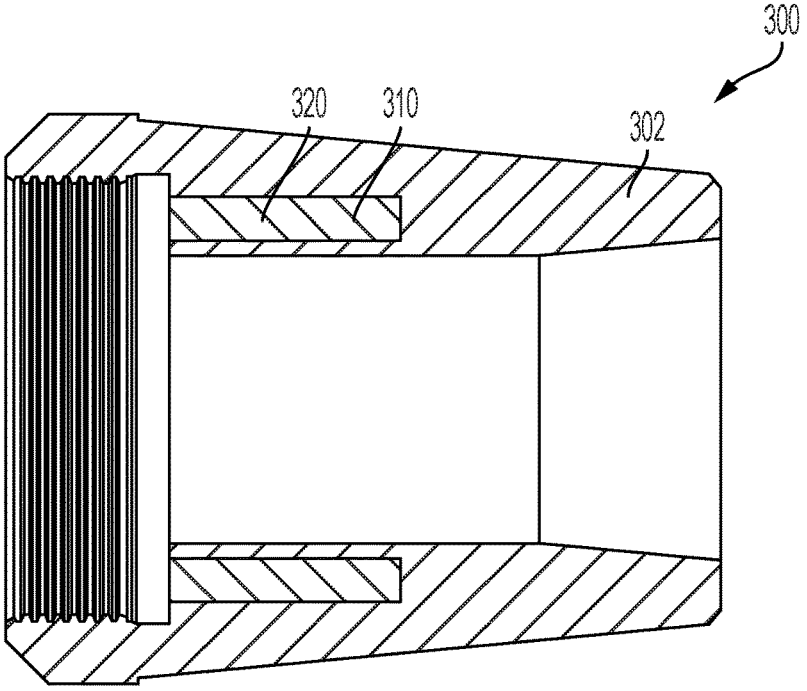
FIG. 3 is a schematic diagram of an exemplary cone for use in a downhole system, such as the one shown in FIG. 1, according to one embodiment of the disclosure.

Referring to FIG. 3 a cone 300 for use with downhole systems such as the system 100 shown in FIG. 1. In the illustrated embodiment, the cone 300 similarly includes cavities 310 disposed within the body 302. In the illustrated embodiment, the cone 300 can be utilized to set a frac plug or any other suitable downhole element and be dissolved after use. Degradation agent 320 is contained within the cavities 310 and can be released when exposed to the wellbore fluid. In the illustrated embodiment, the body 302 degrades at a first rate until the cavity 310 is exposed. Upon exposure of the cavity 310 and the degradation agent 320 within to the wellbore fluid and the body 302, the body 302 can be degraded at a second rate.

Figure 4:
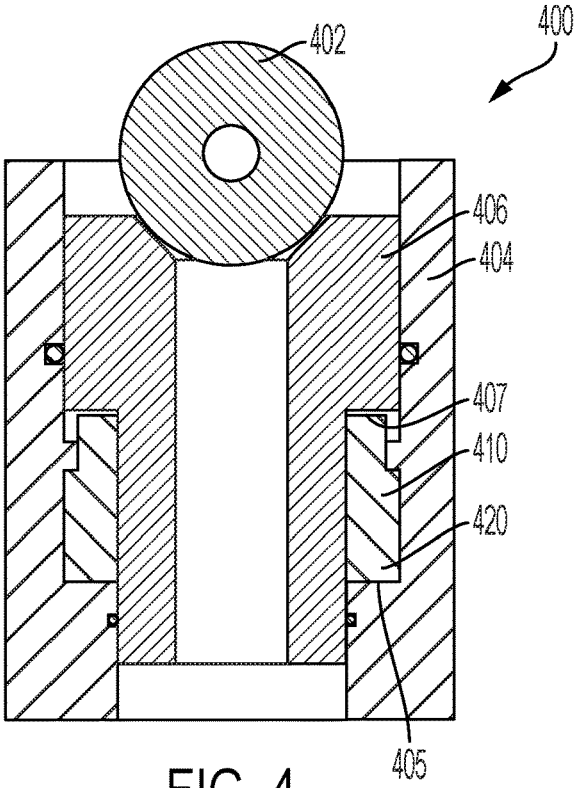
FIG. 4 is a schematic diagram of an exemplary frac plug ball seat for use in a downhole system, such as the one shown in FIG. 1, according to one embodiment of the disclosure.

FIG. 4 shows a frac plug ball seat 400 for use with downhole systems such as the system 100 shown in FIG. 1 for fracturing operations. In the illustrated embodiment, the frac plug ball seat 400 includes a frac ball 402, a sleeve 404, a ball seat body 406, and a breakable container 410 containing a degradation agent 420. In the illustrated embodiment, the ball seat body 406 may be translated downhole upon receiving the frac ball 402 to break the breakable container 410 and release the degradation agent 420.

In the illustrated embodiment, the frac ball 402, the sleeve 404 and the ball seat body 406 can each be formed from dissolvable materials as described herein. The dissolvable materials can degrade at a first rate.

In the illustrated embodiment, the ball seat body 406 can be disposed within the sleeve 404. In the illustrated embodiment, the ball seat body 406 includes a ball seat feature 407 that extends away from the body of the ball seat body 406. Similarly, the sleeve 404 includes a sleeve feature 405 that extends away from the body of the sleeve 404. In the illustrated embodiment, the breakable container 410 is disposed within the volume defined by the sleeve 404 and the ball seat body 406.

In the illustrated embodiment, the breakable container 410 is disposed between the ball seat body 406 and the sleeve 404. The breakable container 410 can be formed from any suitable frangible material. In the illustrated embodiment, the breakable container 410 can be formed of a material to withstand the weight of the ball seat body 406 but break under the impact of the ball 402.

In the illustrated embodiment, the breakable container 410 has a cavity that contains the degradation agent 420. In the illustrated embodiment, the degradation agent 420 can be any suitable degradation agent as described herein. In certain embodiments, the degradation agent 420 can be an active degradation agent that does not need to be exposed to wellbore fluid to be activated.

During operation, the ball 402 is released. The ball 402 is received by the ball seat body 406. In response to receiving the ball 402, the ball seat body 406 translates downwardly within the sleeve 404. As the ball seat body 406 translates downhole, the breakable container 410 is broken and the stored degradation agent 420 is released. Upon exposure of the degradation agent 420 the downhole elements including, but not limited to the ball 402, the sleeve 404 and the ball seat body 406 can be degraded at a second accelerated rate. Advantageously, the degradation rate of the ball 402, the sleeve 404 and the ball seat body 406 can be accelerated as desired without additional intervention.

Figure 5A:
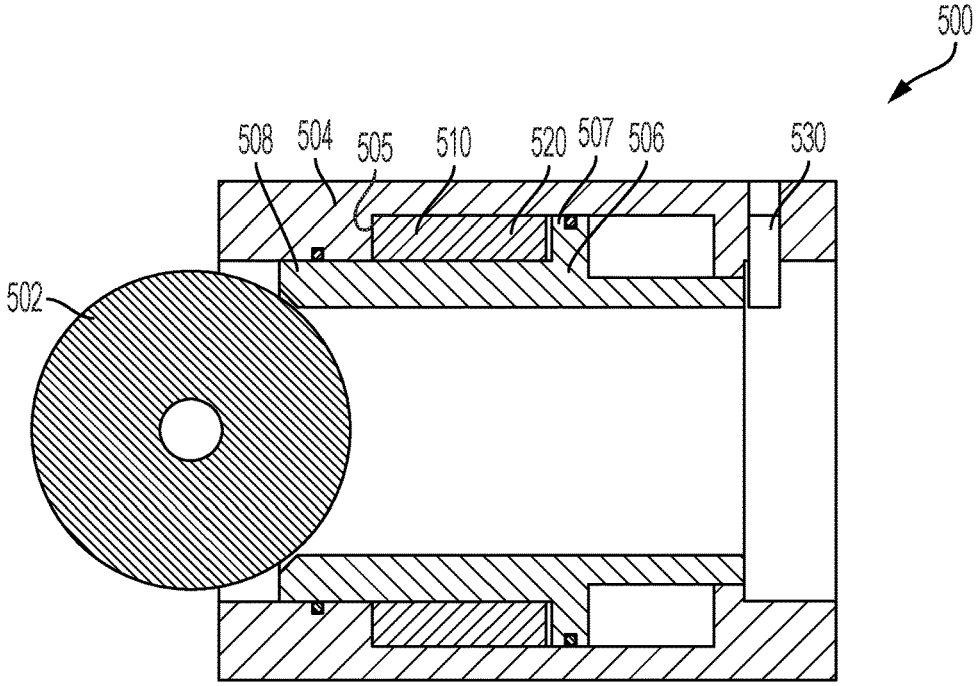
FIG. 5A is a schematic diagram of an exemplary frac plug ball seat shown in an unset position for use in a downhole system, such as the one shown in FIG. 1, according to one embodiment of the disclosure.

FIG. 5A shows a frac plug ball seat 500 for use with downhole systems such as the system 100 shown in FIG. 1 for fracturing operations. In the illustrated embodiment, the frac plug ball seat 500 includes a frac ball 502, a sleeve 504, a ball seat body 506, and a cavity 510 defined by the sleeve 504 and the ball seat body 506 containing a degradation agent 520. In the illustrated embodiment, the ball seat body 506 may be translated downhole upon receiving the frac ball 502 to translate the ball seat body 506 and release the degradation agent 520.

In the illustrated embodiment, the ball seat body 506 can be disposed within the sleeve 504. In the illustrated embodiment, the ball seat body 506 includes a ball seat feature 507 that extends away from the body of the ball seat body 506. Similarly, the sleeve 504 includes a sleeve feature 505 that extends away from the body of the sleeve 504. In the illustrated embodiment, the cavity 510 is defined by the volume created by the sleeve 504 and the ball seat body 506. In the illustrated embodiment, the degradable agent 520 is disposed within the cavity 510.

In the illustrated embodiment, the cavity 510 contains the degradation agent 520. In the illustrated embodiment, the degradation agent 520 can be any suitable degradation agent as described herein.

In the illustrated embodiment, the ball seat body 506 can be retained by a shear device 530, such as a shear pin or a shear screw. When the ball seat body 506 is retained, the cavity 510 is not exposed to wellbore fluid.

Figure 5B:
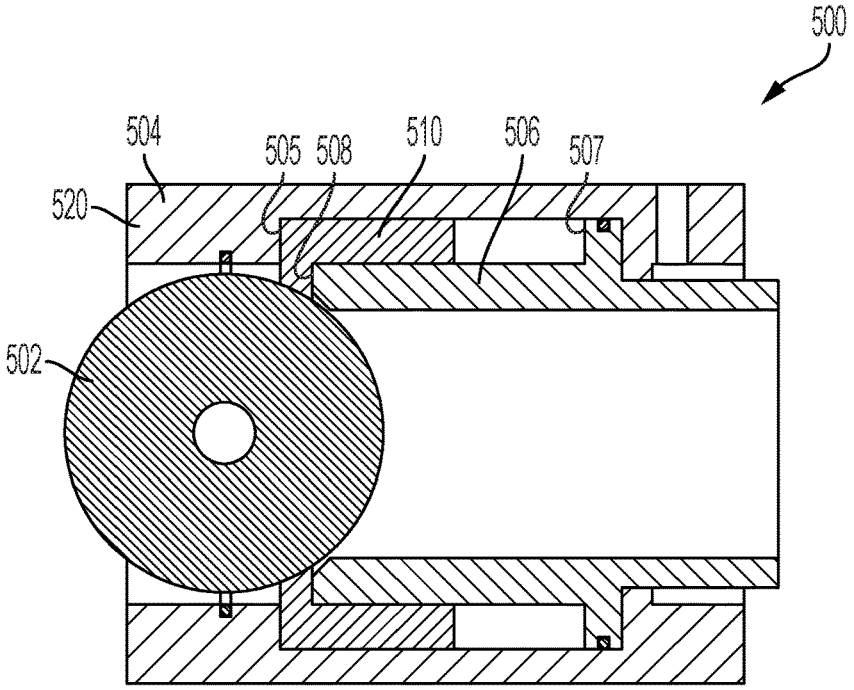
FIG. 5B is a schematic diagram of the frac plug ball seat of FIG. 5B shown in a set position.

Referring to FIG. 5B, during operation, the ball 502 is released. The ball 502 is received by the ball seat body 506. In response to receiving the ball 502, the ball seat body 506 is urged downwardly within the sleeve 504. As the ball seat body 506 translates downhole, the shear device 530 is sheared and the cavity 510 is exposed to the wellbore fluid. In the illustrated embodiment, the stored degradation agent 520 is released an exposed to the wellbore fluid and the downhole elements. Upon exposure of the degradation agent 520 the downhole elements including, but not limited to the ball 502, the sleeve 504 and the ball seat body 506 can be degraded at a second accelerated rate. Advantageously, the degradation rate of the ball 502, the sleeve 504 and the ball seat body 506 can be accelerated as desired without additional intervention.

Therefore in one aspect, a downhole element for use in a wellbore with a wellbore fluid is disclosed, including a body formed from a dissolvable material to degrade at a first rate when exposed to the wellbore fluid, at least one cavity defined by the body, a degradation agent disposed within the at least one cavity, wherein the at least one cavity selectively releases the degradation agent and the degradation agent degrades the body at a second rate when exposed to the wellbore fluid and the dissolvable material. In certain embodiments, the downhole element is a frac plug. In certain embodiments, the downhole element is a cone. In certain embodiments, the cavity is defined by at least one wall of the body. In certain embodiments, the at least one wall includes a reduced thickness portion. In certain embodiments, the degradation agent is a dry acid. In certain embodiments, the dry acid is at least one of boric acid, sodium bisulfate, oxalic acid, sulfamic acid, and phthalic acid. In certain embodiments, the degradation agent is disposed within a breakable container. In certain embodiments, the breakable container is broken by movement of the body. In certain embodiments, movement of the body releases the degradation agent from the cavity. In certain embodiments, the body translates to open the cavity. In certain embodiments, the body is selectively retained. In certain embodiments, the body is selectively retained by a shear device.

In another aspect, a method to accelerate degradation in a wellbore with a wellbore fluid is disclosed, including defining at least one cavity within a body of a downhole element wherein the body is formed from a dissolvable material, disposing a degradation agent within the at least one cavity, exposing the downhole element to the wellbore fluid, degrading a body at a first rate in response to the wellbore fluid, selectively releasing the degradation agent from the cavity, exposing the degradation agent to the wellbore fluid and the dissolvable material, and degrading the dissolvable material at a second rate in response to the wellbore fluid. In certain embodiments, the degradation agent is a dry acid. In certain embodiments, the dry acid is at least one of boric acid, sodium bisulfate, oxalic acid, sulfamic acid, and phthalic acid. In certain embodiments, the degradation agent is disposed within a breakable container. In certain embodiments, the breakable container is broken by movement of the body. In certain embodiments, movement of the body releases the degradation agent from the cavity.

In yet another aspect, a system for use in a wellbore with a wellbore fluid is disclosed, including a casing string disposed within the wellbore, and a downhole element disposed within the casing string, the downhole element including. a body formed from a dissolvable material to degrade at a first rate when exposed to the wellbore fluid, at least one cavity defined by the body, a degradation agent disposed within the at least one cavity, wherein the at least one cavity selectively releases the degradation agent and the degradation agent degrades the body at a second rate when exposed to the wellbore fluid and the dissolvable material.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

What is claimed is:

1. A frac plug for use in a wellbore with a wellbore fluid, the frac plug comprising:

a body of the frac plug formed from a dissolvable material to degrade at a first rate when exposed to the wellbore fluid;

at least one cavity defined by the body; and a degradation agent disposed within the at least one cavity, wherein the at least one cavity selectively releases the degradation agent and the degradation agent degrades the body at a second rate when exposed to the wellbore fluid and the dissolvable material.

2. The downhole element of claim 1, wherein the cavity is defined by at least one wall of the body.

3. The downhole element of claim 2, wherein the at least one wall includes a reduced thickness portion.

4. The downhole element of claim 1, wherein the degradation agent is a dry acid.

5. The downhole element of claim 4, wherein the dry acid is at least one of boric acid, sodium bisulfate, oxalic acid, sulfamic acid, and phthalic acid.

6. The downhole element of claim 1, wherein the degradation agent is disposed within a breakable container.

7. The downhole element of claim 6, wherein the breakable container is broken by movement of the body.

8. The downhole element of claim 1, wherein movement of the body releases the degradation agent from the cavity.

9. The downhole element of claim 8, wherein the body translates to open the cavity.

10. The downhole element of claim 9, wherein the body is selectively retained.

11. The downhole element of claim 10, wherein the body is selectively retained by a shear device.

12. A method to accelerate degradation in a wellbore with a wellbore fluid, the method comprising:

defining at least one cavity within a body of a frac plug wherein the body is formed from a dissolvable material;

disposing a degradation agent within the at least one cavity;

exposing the frac plug to the wellbore fluid;

degrading the body at a first rate in response to the wellbore fluid;

selectively releasing the degradation agent from the cavity;

exposing the degradation agent to the wellbore fluid and the dissolvable material; and degrading the dissolvable material at a second rate in response to the wellbore fluid.

13. The method of claim 12, wherein the degradation agent is a dry acid.

14. The method of claim 13, wherein the dry acid is at least one of boric acid, sodium bisulfate, oxalic acid, sulfamic acid, and phthalic acid.

15. The method of claim 12, wherein the degradation agent is disposed within a breakable container.

16. The method of claim 15, wherein the breakable container is broken by movement of the body.

17. The method of claim 16, wherein movement of the body releases the degradation agent from the cavity.

18. A system for use in a wellbore with a wellbore fluid, the system comprising:

a casing string disposed within the wellbore; and a frac plug disposed within the casing string, the frac plug including:

a body formed from a dissolvable material to degrade at a first rate when exposed to the wellbore fluid;

at least one cavity defined by the body; and a degradation agent disposed within the at least one cavity, wherein the at least one cavity selectively releases the degradation agent and the degradation agent degrades the body at a second rate when exposed to the wellbore fluid and the dissolvable material.

* * * * *